US011574589B2

(12) United States Patent
Yu et al.

(10) Patent No.: US 11,574,589 B2
(45) Date of Patent: Feb. 7, 2023

(54) DRIVING CIRCUIT FOR DISPLAY PANEL, DISPLAY MODULE, COMPENSATION METHOD OF DISPLAY MODULE AND DISPLAY DEVICE

(71) Applicants: Chengdu BOE Optoelectronics Technology Co., Ltd., Sichuan (CN); BOE Technology Group Co., Ltd., Beijing (CN)

(72) Inventors: Yong Yu, Beijing (CN); Zhenwen Hu, Beijing (CN); Wenhong Liu, Beijing (CN); Chang Zhang, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/507,547

(22) Filed: Oct. 21, 2021

(65) Prior Publication Data

US 2022/0310002 A1 Sep. 29, 2022

(30) Foreign Application Priority Data

Mar. 24, 2021 (CN) ..... 202110311442.8

(51) Int. Cl.
*G09G 3/3208* (2016.01)

(52) U.S. Cl.
CPC ... *G09G 3/3208* (2013.01); *G09G 2320/0673* (2013.01)

(58) Field of Classification Search
CPC ..... G09G 3/3208; G09G 2320/0673; G09G 3/3696; G09G 3/2096
See application file for complete search history.

(56) References Cited

U.S. PATENT DOCUMENTS

2007/0052651 A1* 3/2007 Kim ..... G09G 3/2003 345/98
2008/0291190 A1 11/2008 Kim et al.
2010/0321361 A1 12/2010 Weng et al.
2014/0152721 A1 6/2014 Byun et al.
2016/0133192 A1 5/2016 Chae et al.
(Continued)

FOREIGN PATENT DOCUMENTS

CN 103854604 A 6/2014
CN 106297721 A 1/2017
(Continued)

OTHER PUBLICATIONS

CN202110311442.8 first office action.

*Primary Examiner* — Premal R Patel
(74) *Attorney, Agent, or Firm* — IPro, PLLC

(57) ABSTRACT

Disclosed are a driving circuit for a display panel, a display module, a compensation method of the display module, and a display device. According to the present disclosure, a TCON circuit board provided with a plurality of sets of reference voltage outputs is used to independently input a reference voltage to each driver chip through a corresponding set of reference voltage input lines, that is, each driver chip receives an independent reference voltage signal, in this way, the reference voltages output by the TCON circuit board corresponding to each driver chip can be adjusted, the reference voltages received by all driver chips are made to be the same voltages.

13 Claims, 4 Drawing Sheets

(56) References Cited

U.S. PATENT DOCUMENTS

| | | | | |
|---|---|---|---|---|
| 2018/0210261 | A1 | 7/2018 | Chen et al. | |
| 2020/0051478 | A1 | 2/2020 | Wang | |
| 2020/0152132 | A1 | 5/2020 | Kim et al. | |
| 2021/0043149 | A1 | 2/2021 | Yoo et al. | |
| 2021/0090519 | A1* | 3/2021 | Tsuchi | G09G 3/3688 |
| 2022/0199025 | A1* | 6/2022 | Hong | G09G 3/3233 |

FOREIGN PATENT DOCUMENTS

| | | | |
|---|---|---|---|
| CN | 107331365 | A | 11/2017 |
| CN | 108986731 | A | 12/2018 |
| CN | 109559696 | A | 4/2019 |
| CN | 111176039 | A | 5/2020 |
| CN | 111312186 | A | 6/2020 |
| CN | 112419995 | A | 2/2021 |

* cited by examiner

DRIVING CIRCUIT FOR DISPLAY PANEL, DISPLAY MODULE, COMPENSATION METHOD OF DISPLAY MODULE AND DISPLAY DEVICE

CROSS-REFERENCE TO RELATED APPLICATION

This application is based on and claims priority under 35 U.S.C 119 to Chinese Patent Application No. 202110311442.8, filed on Mar. 24, 2021, in the China National Intellectual Property Administration. The entire disclosure of the above application is incorporated herein by reference.

FIELD

The present disclosure relates to the technical field of a display module, in particular to a driving circuit for a display panel, a display module, a compensation method of the display module, and a display device.

BACKGROUND

With the continuous development of a display technology, large-size display panels are more and more favored by people. With the continuous increase of display panels, the requirements for the driving ability are higher and higher. Therefore, a plurality of driver chips (source ICs) need to be spliced in the display panel to drive the display panel. Each driver chip is independent and is provided with its own gamma circuit, and each gamma circuit is configured to generate a gamma voltage to drive the display panel to display. In order to ensure that there is no split screen phenomenon during display of the large-size display panels, the gamma voltages output by each driver chip needs to be consistent.

SUMMARY

Some embodiments of the present disclosure provide a driving circuit for a display panel including a plurality of driver chips, wherein the driving circuit includes:

a TCON circuit board including a plurality of sets of reference voltage outputs; and a printed circuit board including a plurality of sets of reference voltage input lines, wherein first ends of each set of the reference voltage input lines are independently coupled to a corresponding set of the reference voltage outputs, and second ends of each set of the reference voltage input lines are configured to input a reference voltage to the corresponding driver chip.

Optionally, in the above driving circuit for the display panel provided by embodiments of the present disclosure, the driving circuit for the display panel further includes a via circuit board located between the TCON circuit board and the printed circuit board, wherein the via circuit board is provided with a plurality of sets of patch cords, first ends of each set of the patch cords are electrically connected with first ends of a corresponding set of the reference voltage input lines, and second ends of each set of the patch cords are electrically connected with a corresponding set of the reference voltage outputs.

Optionally, in the above driving circuit for the display panel provided by embodiments of the present disclosure, each set of the reference voltage input lines includes a first reference voltage input line and a second reference voltage input line, the first reference voltage input line is configured to input a first voltage to the corresponding driver chip, and the second reference voltage input line is configured to input a second voltage to the corresponding driver chip.

Optionally, in the above driving circuit for the display panel according to embodiments of the present disclosure, a quantity of sets of the reference voltage input lines is an even number, and the sets of the reference voltage input lines are symmetrically distributed on both sides of a center position of the printed circuit board.

Optionally, in the above driving circuit for the display panel provided by embodiments of the present disclosure, a quantity of sets of the reference voltage input lines is an odd number, wherein one set of the reference voltage input lines is disposed in a center position of the printed circuit board, and rest sets of the reference voltage input lines are symmetrically distributed on both sides of the one set of the reference voltage input lines.

Optionally, in the above driving circuit for the display panel provided by embodiments of the present disclosure, the TCON circuit board includes a power management integrated circuit having the plurality of sets of the reference voltage outputs.

Accordingly, some embodiments of the present disclosure also provide a display module, including: a display panel provided with a plurality of driver chips, and the above driving circuit for the display panel electrically connected to the driver chips; wherein each of the driver chips includes a gamma circuit provided with reference voltage inputs, and second ends of each set of the reference voltage input lines are electrically connected with the reference voltage inputs of the corresponding driver chip.

Accordingly, some embodiments of the present disclosure also provide a display device, including the above display module.

Accordingly, some embodiments of the present disclosure also provide a compensation method of the above display module, including:

taking first reference voltages output from reference voltage outputs corresponding to one of the gamma circuits as reference voltages, calculating an impedance difference between an impedance of the reference voltage input lines corresponding to rest of the gamma circuits and an impedance of the reference voltage input lines corresponding to the gamma circuit as the reference voltages; and superimposing the impedance difference with the first reference voltages output from the reference voltage outputs corresponding to the remaining gamma circuits, so that second reference voltage values received by the reference voltage inputs corresponding to each gamma circuit are identical to each other.

Accordingly, some embodiments of the present disclosure also provide a compensation method of the above display module, including:

loading a same reference voltage to all sets of the reference voltage input lines;

detecting a current brightness value of a corresponding binding point of each gamma circuit corresponding to the display panel; and taking a center brightness value of the display panel as a reference brightness, adjusting a reference voltage corresponding to the current brightness value of the corresponding binding point of each gamma circuit, so that the current brightness value of the corresponding binding point of each gamma circuit is identical to each other.

DETAILED DESCRIPTION OF THE EMBODIMENTS

Figure 1:
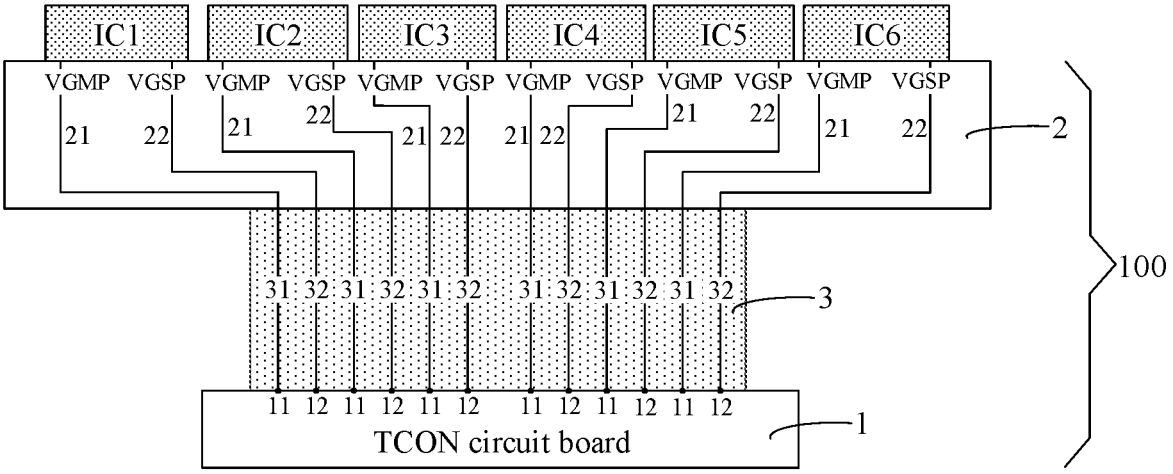
FIG. 1 is a structural schematic diagram of a driving circuit for a display panel provided by embodiments of the present disclosure.

In order to make the objects, technical solutions and advantages of the embodiments of the present disclosure more clear, the technical solutions of the embodiments of the present disclosure will be clearly and completely described below in conjunction with the accompanying drawings of the embodiments of the present disclosure. Obviously, the described embodiments are part of the embodiments of the present disclosure, rather than all of the embodiments. And the embodiments of the present disclosure and the features in the embodiments may be combined with each other without conflict. Based on the described embodiments of the present disclosure, all other embodiments obtained by those of ordinary skill in the art without inventive effort fall within the scope of protection of the present disclosure.

Unless otherwise defined, the technical or scientific terms used in the present disclosure should have the general meanings understood by those of ordinary skill in the art to which the present disclosure belongs. Similar terms such as "including" or "comprising" used in the present disclosure mean that elements or objects appearing before the term encompass elements or objects listed after the term and equivalents thereof, without excluding other elements or objects. Similar terms such as "connection" or "connected" are not limited to physical or mechanical connections, but can include electrical connections, whether direct or indirect. "Inner", "outer", "upper", "lower" and the like are only used to indicate relative positional relationships, which may change accordingly when the absolute positions of the described objects change.

It should be noted that the size and shape of each figure in the drawings do not reflect the true scale, and the purpose is only to schematically illustrate the contents of the present disclosure. And the same or similar reference signs throughout represent the same or similar elements or elements having the same or similar function.

With the continuous maturity of an OLED technology, an OLED display panel has been successfully applied to small-size electronic products such as mobile phones. The advantages of high brightness, wide color gamut and the like have been highly praised by the market. At the same time, in order to meet the increasing requirements of a wide range of users for a display screen, at present, medium-and large-size electronic products such as Notebook, Pad and vehicle-mounted display also begin to use the OLED display panel. This design solution is a design optimization solution for OLED medium-and large-size modules. Different from small-size products such as mobile phones, the size of the medium-and large-size modules is usually 8 inches or above. One source IC cannot meet the requirements of resolution and the number of source channels. Therefore, it is necessary to drive the display panel through a plurality of source ICs. For example, for a large-size 14-inch UHD, 6 source ICs are required to achieve drive. The output of each source IC affects the display of the entire display area of the display panel, so maintaining consistency and stability of the gamma voltage output by 6 source ICs during the same time is critical.

Some embodiments of the present disclosure provide a driving circuit 100 for a display panel, as shown in FIG. 1, the driving circuit 100 is used for driving the display panel to display, and in order to schematically illustrate a connection relationship between the driving circuit 100 and the display panel, FIG. 1 illustrates a plurality of driver chips included in the display panel, for example, by taking the display panel including six driver chips IC1, IC2, IC3, IC4, IC5 and IC6 as an example, the driving circuit 100 includes:

- a TCON circuit board 1 provided with a plurality of sets of reference voltage outputs, for example, taking 6 sets of reference voltage outputs (11 and 12) as an example; and
- a printed circuit board 2 provided with a plurality of sets of reference voltage input lines, for example, by taking 6 sets of reference voltage input lines (21 and 22) as an example, wherein first ends of each set of the reference voltage input lines (21 and 22) are independently coupled to a corresponding set of the reference voltage outputs (11 and 12), for example, a first end of a reference voltage input line 21 in each set of the reference voltage input lines is coupled to the reference voltage output 11, a first end of a reference voltage input line 22 in each set of the reference voltage input lines is coupled to the reference voltage output 12, second ends of each set of the reference voltage input lines (21 and 22) are configured to input a reference voltage to the corresponding driver chip, for example, a second end of the reference voltage input line 21 in a first set of the reference voltage input lines from the left is configured to input a reference voltage to the corresponding driver chip IC1, and a second end of the reference voltage input line 22 in the first set of the reference voltage input lines from the left is configured to input a reference voltage to the corresponding driver chip IC1; for example, a second end of the reference voltage input line 21 in a second set of the reference voltage input lines from the left is configured to input a reference voltage to the corresponding driver chip IC2, a second end of the reference voltage input line 22 in the second set of the reference voltage input lines from the left is configured to input a reference voltage to the corresponding driver chip IC2, and so on.

According to the driving circuit for the display panel provided by embodiments of the present disclosure, the TCON circuit board provided with the plurality of sets of the reference voltage outputs is used to independently input a reference voltage to each driver chip through the corresponding set of the reference voltage input lines, that is, each driver chip receives an independent reference voltage signal, in this way, the reference voltages output by the TCON circuit board corresponding to each driver chip can be adjusted, the reference voltages received by all driver chips are made to be the same, so that all driver chips output consistent gamma voltages, so as to avoid the inconsistency of gamma voltages output by different driver chips due to different impedances of each set of the reference voltage input lines, which leads to the split screen phenomenon of display of the display panel and improve the display quality.

It should be noted that the above driving circuit for the display panel provided by the embodiments of the present disclosure is exemplified by inputting reference voltages to 6 driver chips, that is, 6 sets of reference voltage input lines are included. Of course, in specific implementation, the number of driver chips required can be designed according to factors such as the size of the panel, and then the number of sets of reference voltage input lines included in the driving circuit can be designed, and can be less than 6 sets or greater than 6 sets, which is not limited here.

In the above driving circuit for the display panel provided by embodiments of the present disclosure, as shown in FIG. 1, the driving circuit for the display panel further includes a via circuit board 3 located between the TCON circuit board 1 and the printed circuit board 2, wherein the via circuit board 3 is provided with a plurality of sets of patch cords (31 and 32), first ends of each set of the patch cords (31 and 32) are electrically connected with first ends of a corresponding set of the reference voltage input lines (21 and 22), for example, a first end of a patch cord 31 in a first set of the patch cords from the left is electrically connected with the first end of the reference voltage input line 21 in the first set of the reference voltage input lines from the left, and a first end of a patch cord 32 in the first set of the patch cords from the left is electrically connected with the first end of the reference voltage input line 22 in the first set of the reference voltage input lines from the left; for example, a first end of a patch cord 31 in a second set of the patch cords from the left is electrically connected with the first end of the reference voltage input line 21 in the second set of the reference voltage input lines from the left, a first end of a patch cord 32 in the second set of the patch cords from the left is electrically connected with the first end of the reference voltage input line 22 in the second set of the reference voltage input lines from the left, and so on; second ends of each set of the patch cords (31 and 32) are electrically connected with a corresponding set of the reference voltage outputs (11 and 12), for example, a second end of a patch cord 31 of each set of the patch cords is electrically connected with the reference voltage output 11 and a second end of a patch cord 32 of each set of the patch cords is electrically connected with the reference voltage output 12.

Optionally, as shown in FIG. 1, the via circuit board 3 may be a flexible circuit board, FPC.

Figure 2:
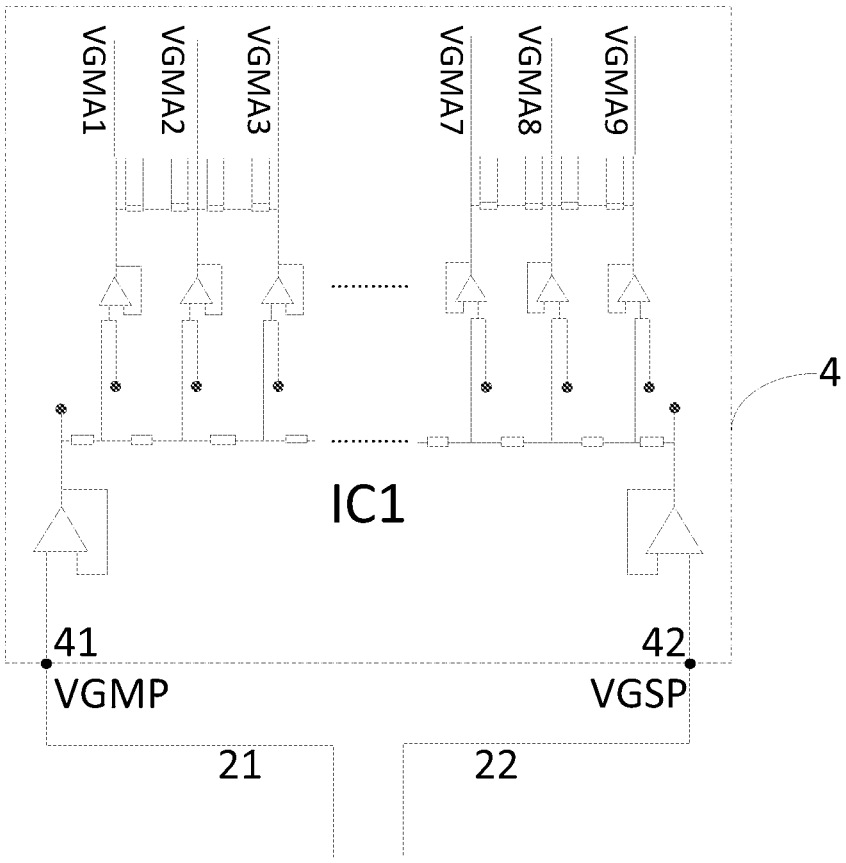
FIG. 2 is a structural schematic diagram of a gamma circuit of one driver chip in FIG. 1.
Figure 3:
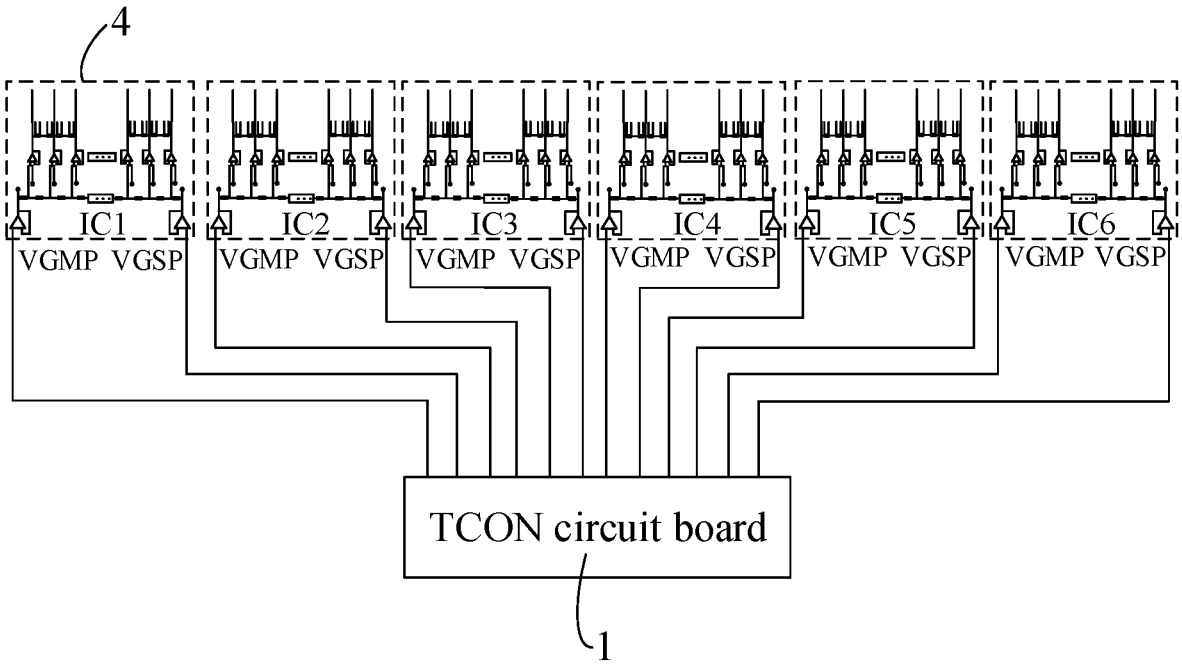
FIG. 3 is a structural schematic diagram of gamma circuits of all driver chips in FIG. 1.

In the above driving circuit for the display panel provided the embodiments of the present disclosure, as shown in FIG. 1, each set of the reference voltage input lines (21 and 22) includes a first reference voltage input line 21 and a second reference voltage input line 22, each first reference voltage input line 21 is configured to input a first voltage (VGMP) to the corresponding driver chip (e.g. IC1), and each second reference voltage input line 22 is configured to input a second voltage (VGSP) to the corresponding driver chip (e.g. IC1). Optionally, the first voltage (VGMP) is generally a high voltage and the second voltage (VGSP) is generally a low voltage. As shown in FIGS. 2 and 3, FIG. 2 is a structural schematic diagram of a circuit of one driver chip in FIG. 1, by taking the driver chip being IC1 as an example, FIG. 3 is a structural schematic diagram of circuits of driver chips in FIG. 1, the circuit of each driver chip in FIG. 3 is shown in FIG. 2, the driver chip IC1 includes a gamma circuit 4, the gamma circuit 4 has reference voltage inputs (41 and 42), the second ends (VGMP and VGSP) of each set of the reference voltage input lines (21 and 22) are electrically connected with the reference voltage inputs (41 and 42) of the corresponding driver chip, e.g. the second end VGMP of the reference voltage input line 21 is electrically connected with the reference voltage input 41 and the second end VGSP of the reference voltage input line 22 is electrically connected with the reference voltage input 42. By taking each driver chip outputting 9 gamma voltages (VGMA1, VGMA2, . . . VGMA9) as an example, the gamma voltage is obtained by voltage division on a differential voltage between the first voltage VGMP and the second voltage VGSP by a resistor string, the specific voltage division principle is the same as that in the prior art, which is not described in detail in the embodiments of the present disclosure. The purpose of the present disclosure is to illustrate that each set of the first voltage VGMP and the second voltage VGSP is output via an independent reference voltage input line, i.e. each driver chip receives an independent reference voltage signal, in this way, the reference voltages output by the TCON circuit board 1 corresponding to each driver chip can be adjusted, the reference voltages (VGMP and VGSP) received by all driver chips are made to be the same, so that all driver chips output consistent gamma voltages, i.e. VGMA1 in each group of gamma voltages is consistent, VGMA2 in each group of gamma voltages is consistent, VGMA3 in each group of gamma voltages is consistent, and so on.

In the above driving circuit for the display panel provided by embodiments of the present disclosure, as shown in FIG. 1, the number of sets of the plurality of sets of the reference voltage input lines (21 and 22) may be an even number (FIG. 1 takes 6 sets as an example), and the plurality of sets of the reference voltage input lines (21 and 22) are symmetrically distributed on both sides of a center position of the printed circuit board 2. In this way, the fabrication process of the plurality of sets of the reference voltage input lines (21 and 22) located on both sides of the central position of the printed circuit board 2 can be unified, thereby reducing the difficulty of fabrication.

Figure 4:
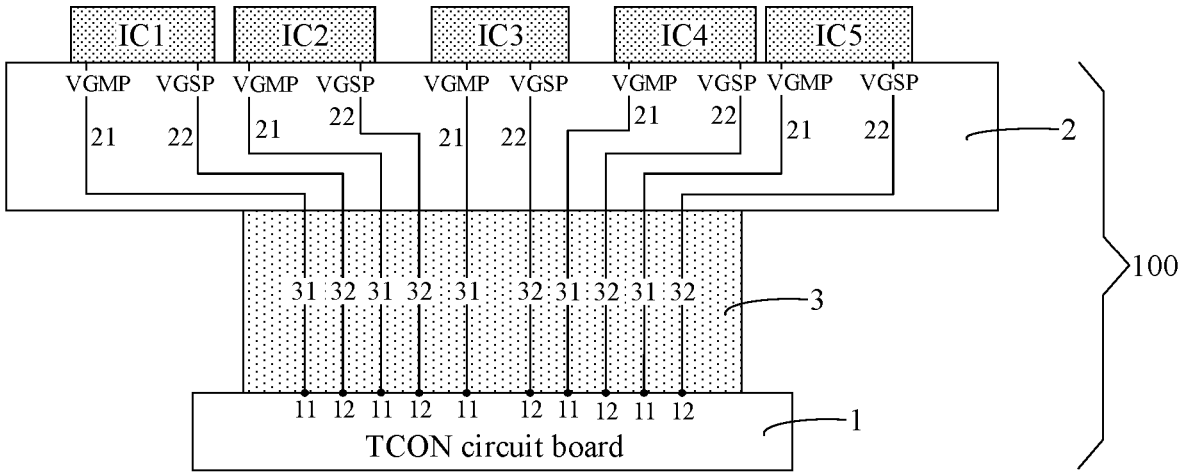
FIG. 4 is a structural schematic diagram of another driving circuit for a display panel provided by embodiments of the present disclosure.

In the above driving circuit for the display panel provided by the embodiments of the present disclosure, as shown in FIG. 4, the number of sets of the plurality of sets of reference voltage input lines (21 and 22) may be an odd number (FIG. 4 takes 5 sets as an example), wherein one set of the reference voltage input lines (21 and 22) is arranged in a central position of the printed circuit board 2 and the remaining sets of the reference voltage input lines (21 and 22) are symmetrically distributed on both sides of the one set of the reference voltage input lines. In this way, the fabrication process of the plurality of sets of the reference voltage input lines (21 and 22) located on both sides of the set of the reference voltage input lines in the center can be unified and the difficulty of fabrication can also be reduced.

Figure 5:
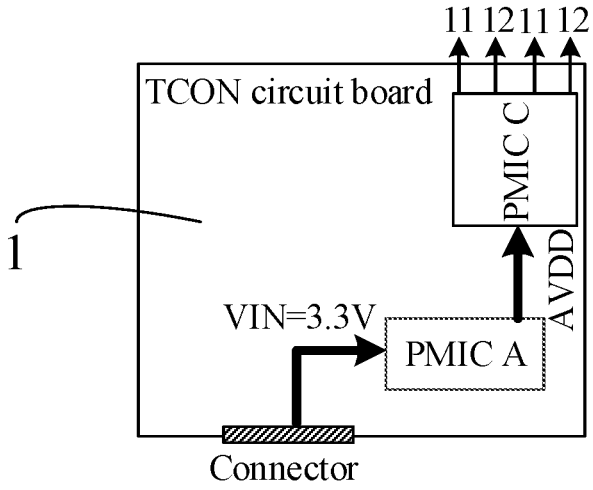
FIG. 5 is a structural schematic diagram of a TCON circuit board provided by embodiments of the present disclosure.

In the above driving circuit for the display panel provided by embodiments of the present disclosure, as shown in FIG. 5, the driving circuit for the display panel further includes a connector, the connector is used for connecting an external power supply, the TCON circuit board 1 includes a power management integrated circuit (PMIC A and PMIC C), for example, the external power supply inputs 3.3 V voltage to the power management integrated circuit PMIC A through the connector, the power management integrated circuit PMIC A converts the 3.3 V voltage into signals in an ΔVDD format to be input into the power management integrated circuit PMIC C, the signals in the ΔVDD format are VGMP and VGSP signals, the power management integrated circuit PMIC C has a plurality of sets of reference voltage outputs (11 and 12), and only 2 sets of the reference voltage outputs (11 and 12) are shown in FIG. 5.

Figure 6:
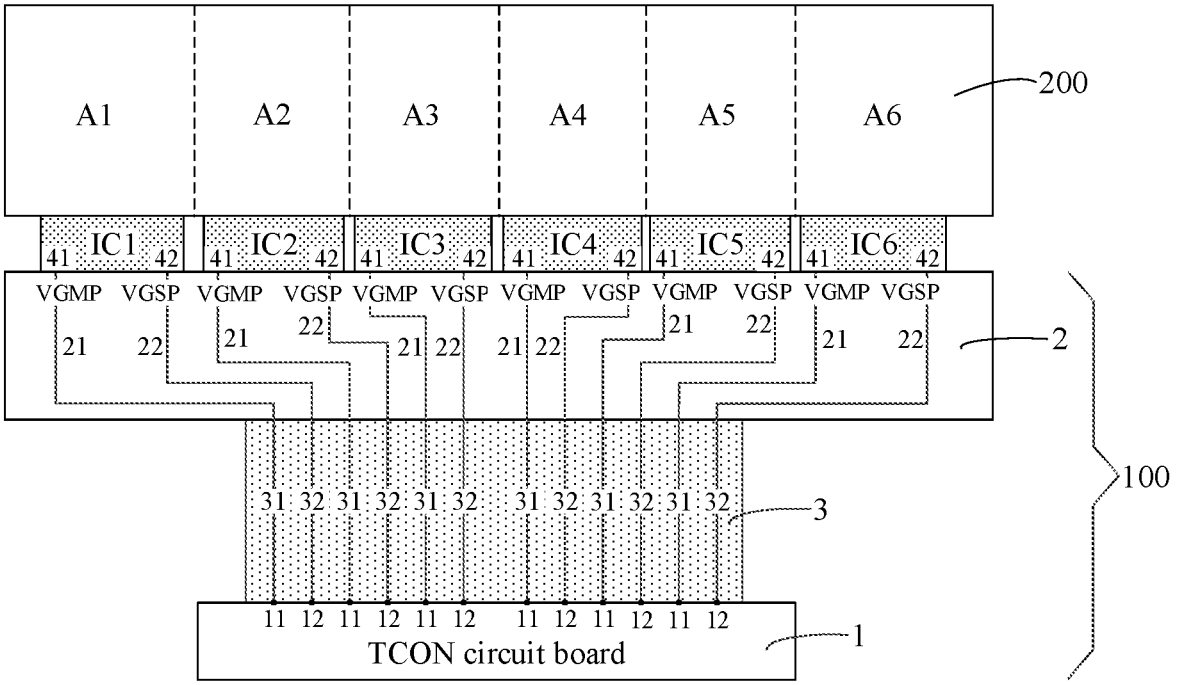
FIG. 6 is a structural schematic diagram of a display device provided by embodiments of the present disclosure.

Based on the same inventive concept, some embodiments of the present disclosure also provide a display module, as shown in FIG. 6, including: a display panel 200 provided with a plurality of driver chips (IC1, IC2, IC3, IC4, IC5, and IC6), and the above driving circuit 100 for the display panel electrically connected with the driver chips (IC1, IC2, IC3, IC4, IC5, and IC6); wherein, as shown in FIGS. 2 and 3, each driver chip includes a gamma circuit 4 having reference voltage inputs (41 and 42), the second ends (VGMP and VGSP) of each set of the reference voltage input lines (21 and 22) are electrically connected with the reference voltage inputs (41 and 42) of the corresponding driver chip. For example, the second end VGMP of the reference voltage input line 21 is electrically connected with a reference voltage input 41, and the second end VGSP of the reference voltage input line 22 is electrically connected with a reference voltage input 42. By taking each driver chip outputting 9 gamma voltages (VGMA1, VGMA2, . . . VGMA9) as an example, the gamma voltage is obtained by voltage division on a differential voltage between the first voltage VGMP and the second voltage VGSP by a resistor string, the specific voltage division principle is the same as that in the prior art, which is not described in detail in the embodiments of the present disclosure. The purpose of the present disclosure is to illustrate that each set of the first voltage VGMP and the second voltage VGSP is output via an independent reference voltage input line, i.e. each driver chip receives an independent reference voltage signal, in this way, the reference voltages output by the TCON circuit board 1 corresponding to each driver chip can be adjusted, the reference voltages (VGMP and VGSP) received by all driver chips are made to be the same, so that all driver chips output consistent gamma voltages, i.e. VGMA1 in each group of gamma voltages is consistent, VGMA2 in each group of gamma voltages is consistent, VGMA3 in each group of gamma voltages is consistent, and so on.

A compensation method of the display module shown in FIG. 6 provided by the embodiments of the present disclosure will be described in detail below.

A first compensation method: as shown in FIGS. 2, 3 and 6, by taking first reference voltages output from reference voltage outputs corresponding to one of the gamma circuits as reference voltages, for example, by taking a first reference voltage output from a reference voltage output 11 corresponding to the gamma circuit 4 corresponding to the driver chip IC1 as a first reference voltage V1, and taking a first reference voltage output from a reference voltage output 12 as a second reference voltage V2, an impedance difference between an impedance of the reference voltage input lines corresponding to the remaining gamma circuits and an impedance of the reference voltage input lines corresponding to the gamma circuit as the reference voltages is calculated, since the lengths of the patch cords (31 and 32) are substantially the same, the impedance between the patch cords corresponding to different gamma circuits can be ignored, for example, an impedance difference ΔV1 between the impedance of the reference voltage input line 21 corresponding to the gamma circuit 4 corresponding to the driver chip IC2 and the impedance of the reference voltage input line 21 corresponding to the gamma circuit 4 as the first reference voltage V1 is calculated, for example, an impedance difference ΔV2 between the impedance of the reference voltage input line 21 corresponding to the gamma circuit 4 corresponding to the driver chip IC3 and the impedance of the reference voltage input line 21 corresponding to the gamma circuit 4 as the first reference voltage V1 is calculated, for example, an impedance difference ΔV3 between the impedance of the reference voltage input line 21 corresponding to the gamma circuit 4 corresponding to the driver chip IC4 and the impedance of the reference voltage input line 21 corresponding to the gamma circuit 4 as the first reference voltage V1 is calculated, and so on; for example, an impedance difference ΔV1' between the impedance of the reference voltage input line 22 corresponding to the gamma circuit 4 corresponding to the driver chip IC2 and the impedance of the reference voltage input line 22 corresponding to the gamma circuit 4 as the second reference voltage V2 is calculated, for example, an impedance difference ΔV2' between the impedance of the reference voltage input line 22 corresponding to the gamma circuit 4 corresponding to the driver chip IC3 and the impedance of the reference voltage input line 22 corresponding to the gamma circuit 4 as the second reference voltage V2 is calculated, for example an impedance difference ΔV3' between the impedance of the reference voltage input line 22 corresponding to the gamma circuit 4 corresponding to the driver chip IC4 and the impedance of the reference voltage input line 22 corresponding to the gamma circuit 4 as the second reference voltage V2 is calculated, and so on.

The impedance difference is superimposed with the first reference voltages output from the reference voltage outputs corresponding to the remaining gamma circuits, so that second reference voltage values received by the reference voltage inputs corresponding to each gamma circuit are the same; for example, ΔV1 is superimposed with a first reference voltage (the first reference voltage V1) output from the reference voltage output 11 corresponding to the gamma circuit 4 corresponding to the driver chip IC2, i.e. ΔV1+V1 is used as the reference voltage output from the reference voltage output 11 corresponding to the gamma circuit 4 corresponding to the driver chip IC2, so that the second reference voltage value received by the reference voltage input 41 corresponding to the gamma circuit corresponding to the driver chip IC2 can be made to be the same; for example, ΔV1' is superimposed with a first reference voltage (the second reference voltage V2) output from the reference voltage output 12 corresponding to the gamma circuit 4 corresponding to the driver chip IC2, i.e. ΔV1'+V2 is used as the reference voltage output from the reference voltage output 12 corresponding to the gamma circuit 4 corresponding to the driver chip IC2, so that the second reference voltage value received by the reference voltage input 42 corresponding to the gamma circuit corresponding to the driver chip IC2 can be made to be the same, and so on.

In some embodiments, the reference voltages output from the reference voltage outputs 11 and 12 corresponding to each gamma circuit after debugging can be burned into the power management integrated circuit PMIC C of FIG. 5, for batch products, because the design of the via circuit board and printed circuit board used by the products of the same project is completely consistent, the parameters generally applicable to the project can be finally obtained by analyzing a certain number of product configuration parameters.

Thus, the above first compensation method provided by embodiments of the present disclosure can compensate the second reference voltage values received by the reference voltage inputs corresponding to the gamma circuit corresponding to each driver chip according to the impedance difference of the reference voltage input lines corresponding to each gamma circuit, so that the second reference voltage values received by all driver chips are the same, all driver chips output consistent gamma voltages, so as to avoid the inconsistency of gamma voltages output by different driver chips due to different impedances of each set of the reference voltage input lines, which leads to the split screen phenomenon of display of the display panel and improve the display quality.

A second compensation method: as shown in FIGS. 2, 3 and 6, a same reference voltage is loaded to all sets of the reference voltage input lines (21 and 22), for example, a reference voltage V3 is loaded to all reference voltage input lines 21 and a reference voltage V4 is loaded to all reference voltage input lines 22;

a current brightness value of a corresponding binding point of each gamma circuit 4 corresponding to the display panel 200 is detected, the current brightness value of the binding point can be the current brightness value corresponding to different gray scales, generally there are 246 gray scales in total from 0 to 255, the current brightness values of some important binding points may be detected, and for example, a current brightness value of a 155 gray scale is detected; optionally, the brightness may be detected with an optical probe; and by taking a center brightness value of the display panel 200 as a reference brightness, reference voltages (reference voltages output from the reference voltage outputs 11 and 12) corresponding to the current brightness value of the corresponding binding point (the 155 gray scale) of each gamma circuit 4 are adjusted, until the current brightness value of the corresponding binding point (the 155 gray scale) of each gamma circuit 4 is made to be the same.

In some embodiments, the reference voltages output from the reference voltage outputs 11 and 12 corresponding to each gamma circuit after debugging can be burned into the power management integrated circuit PMIC C of FIG. 5, for batch products, because the design of the via circuit board and printed circuit board used by the products of the same project is completely consistent, the parameters generally applicable to the project can be finally obtained by analyzing a certain number of product configuration parameters.

It should be noted that in the above compensation method of the display module provided by the embodiments of the present disclosure, when detecting the current brightness value of the corresponding binding point of each gamma circuit, it is usually to detect and compensate the voltage value of the typical binding point position in the gamma circuit. Of course, all binding point positions in each gamma circuit can also be detected, and in this way, the processing capacity of the driver chip is required to be relatively high. Which binding points to detect and compensate are selected according to the actual use, which is not specifically limited here.

Therefore, the above second compensation method provided by the embodiments of the present disclosure can adjust the reference voltage corresponding to the current brightness value of the corresponding binding point of each gamma circuit according to the center brightness value of the display panel until the current brightness value of the corresponding binding point of each gamma circuit is the same, so that the reference voltages received by all driver chips are the same, all driver chips output consistent gamma voltages, so as to avoid the inconsistency of gamma voltages output by different driver chips due to different impedances of each set of the reference voltage input lines, which leads to the split screen phenomenon of display of the display panel and improve the display quality.

Figure 7:
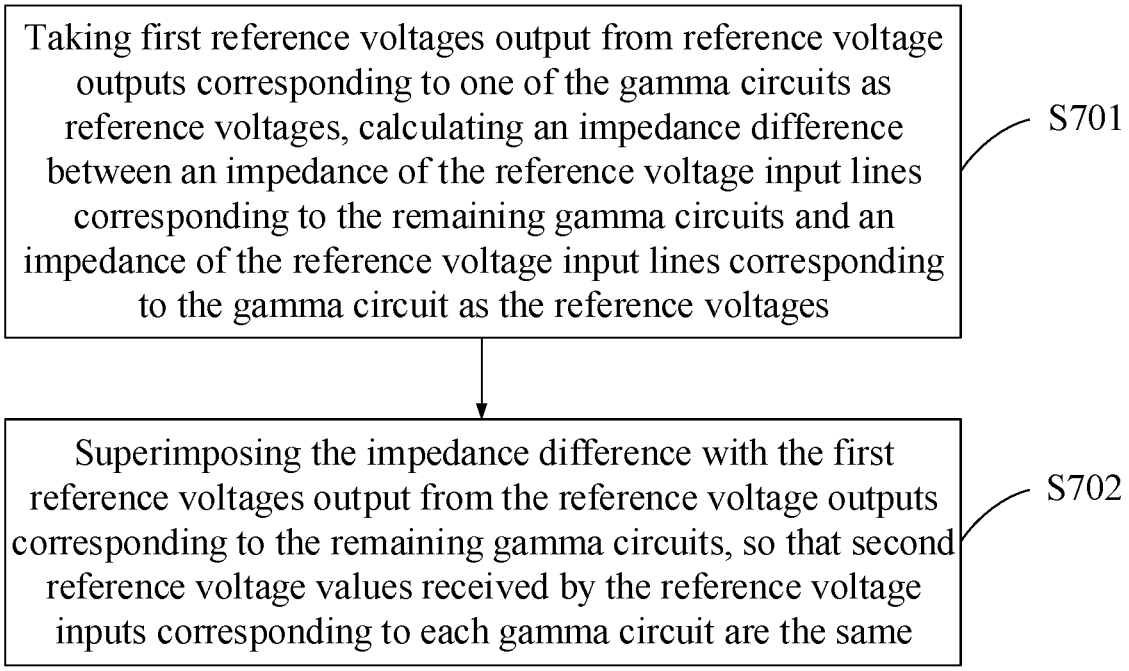
FIG. 7 is a flow diagram of a compensation method of a display module provided by embodiments of the present disclosure.

Based on the same inventive concept, some embodiments of the present disclosure also provide a compensation method of the above display module, as shown in FIG. 7, including:

S701 by taking first reference voltages output from reference voltage outputs corresponding to one of the gamma circuits as reference voltages, calculating an impedance difference between an impedance of the reference voltage input lines corresponding to the remaining gamma circuits and an impedance of the reference voltage input lines corresponding to the gamma circuit as the reference voltages; and S702 superimposing the impedance difference with the first reference voltages output from the reference voltage outputs corresponding to the remaining gamma circuits, so that second reference voltage values received by the reference voltage inputs corresponding to each gamma circuit are the same.

The principle of the compensation method of the display module provided by embodiments of the present disclosure is the same as that of the compensation method in embodiments of the display module. The principle of the compensation method of the display module can refer to the working principle of the display module, which is not repeated here.

Figure 8:
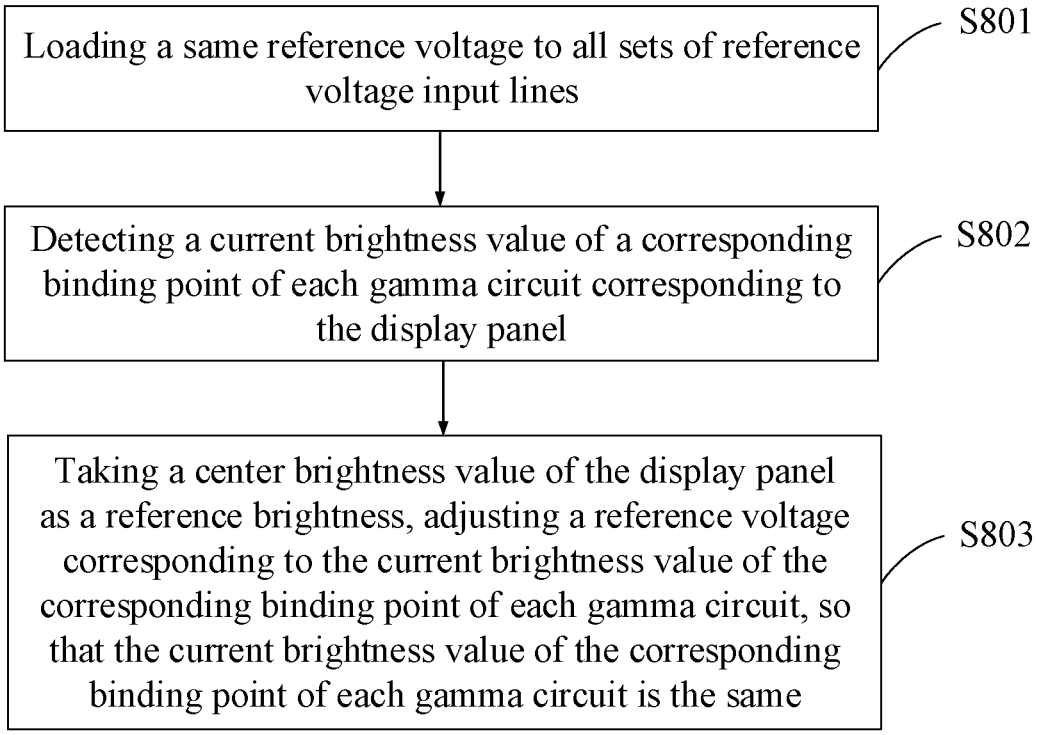
FIG. 8 is a flow diagram of another compensation method of a display module provided by embodiments of the present disclosure.

Based on the same inventive concept, some embodiments of the present disclosure also provide a compensation method of the above display module, as shown in FIG. 8, including:

S801 loading a same reference voltage to all sets of the reference voltage input lines;

S802 detecting a current brightness value of a corresponding binding point of each gamma circuit corresponding to the display panel; and S803 by taking a center brightness value of the display panel as a reference brightness, adjusting a reference voltage corresponding to the current brightness value of the corresponding binding point of each gamma circuit, so that the current brightness value of the corresponding binding point of each gamma circuit is the same.

The principle of the compensation method of the display module provided by embodiments of the present disclosure is the same as that of the compensation method in embodiments of the display module. The principle of the compensation method of the display module can refer to the working principle of the display module, which is not repeated here.

Based on the same inventive concept, some embodiments of the present disclosure also provide a display device, including the above display module provided by embodiments of the present disclosure. The principle of solving the problem of the display device is similar to that of the aforementioned display module, and thus the implementation of the display device can refer to the implementation of the above display module, and the repetition will not be repeated here.

In the above display device provided by embodiments of the present disclosure may be an organic light-emitting display device, which is not limited here.

In the above display device provided by embodiments of the present disclosure may be any large-sized product or component having a display function, such as a tablet computer, a television, a display, a notebook computer, a digital photo frame, a navigator, and the like. Other essential components of the display device should be understood by those of ordinary skill in the art and will not be described herein and should not be taken as a limitation of the present disclosure.

According to the driving circuit for the display panel, the display module, the compensation method of the display module, and the display device provided by embodiments of the present disclosure, the driving circuit for the display panel includes: the TCON circuit board provided with the plurality of sets of the reference voltage outputs; and the printed circuit board provided with the plurality of sets of the reference voltage input lines, wherein the first ends of each set of the reference voltage input lines are independently coupled to the corresponding set of the reference voltage outputs, and the second ends of each set of the reference voltage input lines are configured to input a reference voltage to the corresponding driver chip. According to the present disclosure, the TCON circuit board provided with the plurality of sets of the reference voltage outputs is used to independently input a reference voltage to each driver chip through the corresponding set of the reference voltage input lines, that is, each driver chip receives an independent reference voltage signal, in this way, the reference voltages output by the TCON circuit board corresponding to each driver chip can be adjusted, the reference voltages received by all driver chips are made to be the same, so that all driver chips output consistent gamma voltages, so as to avoid the inconsistency of gamma voltages output by different driver chips due to different impedances of each set of the reference voltage input lines, which leads to the split screen phenomenon of display of the display panel and improve the display quality.

While the preferred embodiments of the present disclosure have been described, those skilled in the art may make additional changes and modifications to these embodiments once they know the basic inventive concept. Therefore, the appended claims are intended to be interpreted as including preferred embodiments and all changes and modifications falling within the scope of the present disclosure.

Obviously, those skilled in the art can make various changes and modifications to the embodiments of the present disclosure without departing from the spirit and scope of the embodiments of the present disclosure. Thus, if these changes and modifications of the embodiments of the present disclosure fall within the scope of the claims of the present disclosure and its equivalent technology, the present disclosure is also intended to include these changes and modifications.

What is claimed is:

1. A driving circuit for a display panel comprising a plurality of driver chips, wherein the driving circuit comprises:

a TCON circuit board comprising a plurality of sets of reference voltage outputs; and a printed circuit board comprising a plurality of sets of reference voltage input lines, wherein first ends of each set of the reference voltage input lines are independently coupled to a corresponding set of the reference voltage outputs, and second ends of each set of the reference voltage input lines are configured to input a reference voltage to a corresponding driver chip;

wherein each set of the reference voltage input lines comprises a first reference voltage input line and a second reference voltage input line, the first reference voltage input line is configured to input a first voltage to a corresponding driver chip, and the second reference voltage input line is configured to input a second voltage to the corresponding driver chip.

2. The driving circuit for the display panel according to claim 1, further comprising a via circuit board located between the TCON circuit board and the printed circuit board, wherein the via circuit board is provided with a plurality of sets of patch cords, first ends of each set of the patch cords are electrically connected with first ends of a corresponding set of the reference voltage input lines, and second ends of each set of the patch cords are electrically connected with a corresponding set of the reference voltage outputs.

3. The driving circuit for the display panel according to claim 1, wherein a quantity of sets of the reference voltage input lines is an even number, and the sets of the reference voltage input lines are symmetrically distributed on both sides of a center position of the printed circuit board.

4. The driving circuit for the display panel according to claim 1, wherein a quantity of sets of the reference voltage input lines is an odd number, wherein one set of the reference voltage input lines is disposed in a center position of the printed circuit board, and rest sets of the reference voltage input lines are symmetrically distributed on both sides of the one set of the reference voltage input lines.

5. The driving circuit for the display panel according to claim 1, wherein the TCON circuit board comprises a power management integrated circuit having the plurality of sets of the reference voltage outputs.

6. A display module, comprising: a display panel provided with a plurality of driver chips, and a driver circuit for the display panel electrically connected with the driver chips; wherein each of the driver chips comprises a gamma circuit provided with reference voltage inputs, and second ends of each set of the reference voltage input lines are electrically connected with the reference voltage inputs of the corresponding driver chip;

wherein the driver circuit comprises:

a TCON circuit board comprising a plurality of sets of reference voltage outputs; and a printed circuit board comprising a plurality of sets of reference voltage input lines, wherein first ends of each set of the reference voltage input lines are independently coupled to a corresponding set of the reference voltage outputs, and second ends of each set of the reference voltage input lines are configured to input a reference voltage to a corresponding driver chip;

wherein each set of the reference voltage input lines comprises a first reference voltage input line and a second reference voltage input line, the first reference voltage input line is configured to input a first voltage to a corresponding driver chip, and the second reference voltage input line is configured to input a second voltage to the corresponding driver chip.

7. The display module according to claim 6, wherein the driver circuit further comprises a via circuit board located between the TCON circuit board and the printed circuit board, wherein the via circuit board is provided with a plurality of sets of patch cords, first ends of each set of the patch cords are electrically connected with first ends of a corresponding set of the reference voltage input lines, and second ends of each set of the patch cords are electrically connected with a corresponding set of the reference voltage outputs.

8. The display module according to claim 6, wherein a quantity of sets of the reference voltage input lines is an even number, and the sets of the reference voltage input lines are symmetrically distributed on both sides of a center position of the printed circuit board.

9. The display module according to claim 6, wherein a quantity of sets of the reference voltage input lines is an odd number, wherein one set of the reference voltage input lines is disposed in a center position of the printed circuit board, and remaining sets of the reference voltage input lines are symmetrically distributed on both sides of the one set of the reference voltage input lines.

10. The display module according to claim 6, wherein the TCON circuit board comprises a power management integrated circuit having the plurality of sets of the reference voltage outputs.

11. A display device, comprising the display module according to claim 6.

12. A compensation method for the display module according to claim 6, comprising:

taking first reference voltages output from reference voltage outputs corresponding to one of the gamma circuits as reference voltages, calculating an impedance difference between an impedance of the reference voltage input lines corresponding to rest of the gamma circuits and an impedance of the reference voltage input lines corresponding to the gamma circuit as the reference voltages; and superimposing the impedance difference with the first reference voltages output from the reference voltage outputs corresponding to the rest of the gamma circuits, so that second reference voltage values received by the reference voltage inputs corresponding to each gamma circuit are identical to each other.

13. A compensation method for the display module according to claim 6, comprising:

loading a same reference voltage to all sets of the reference voltage input lines;

detecting a current brightness value of a corresponding binding point of each gamma circuit corresponding to the display panel; and taking a center brightness value of the display panel as a reference brightness, adjusting a reference voltage corresponding to a current brightness value of a corresponding binding point of each gamma circuit, so that the current brightness value of the corresponding binding point of each gamma circuit is identical to each other.

* * * * *